US009890733B2

(12) United States Patent
Nagasawa

(10) Patent No.: US 9,890,733 B2
(45) Date of Patent: Feb. 13, 2018

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Hiroi Nagasawa, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 15/333,226

(22) Filed: Oct. 25, 2016

(65) Prior Publication Data

US 2017/0167425 A1 Jun. 15, 2017

(30) Foreign Application Priority Data

Dec. 9, 2015 (JP) ..... 2015-240498

(51) Int. Cl.

| | |
|---|---|
| ***F02D 41/30*** | (2006.01) |
| ***F02D 31/00*** | (2006.01) |
| ***F02D 41/24*** | (2006.01) |
| ***F02D 11/10*** | (2006.01) |
| *F02D 41/10* | (2006.01) |
| *F02D 41/14* | (2006.01) |

(52) U.S. Cl.

CPC ..... *F02D 41/3005* (2013.01); *F02D 11/105* (2013.01); *F02D 31/007* (2013.01); *F02D 41/2422* (2013.01); *F02D 41/107* (2013.01); *F02D 2041/1409* (2013.01); *F02D 2200/0404* (2013.01); *F02D 2200/602* (2013.01); *F02D 2250/18* (2013.01); *F02D 2250/26* (2013.01)

(58) Field of Classification Search

CPC .... F02D 41/30; F02D 41/3005; F02D 11/105; F02D 31/007; F02D 41/2422; F02D 29/02; F02D 2200/0404; F02D 2200/602; F02D 2250/18; F02D 2250/26

See application file for complete search history.

(56) References Cited

U.S. PATENT DOCUMENTS 8,485,942 B2 * 7/2013 Matsushita ..... F02D 29/02 477/120

FOREIGN PATENT DOCUMENTS

DE 10060298 A1 10/2001
DE 102004011814 A1 9/2005

(Continued)

*Primary Examiner* — Hieu T Vo

(74) *Attorney, Agent, or Firm* — Finnegan, Henderson, Farabow, Garrett & Dunner, LLP

(57) ABSTRACT

A control device is configured to calculate a basic accelerator request torque based on an accelerator opening degree detected by an accelerator opening degree sensor, and calculate a target acceleration increase amount based on relations between the target acceleration increase amount and an accelerator opening degree increase amount. Further, the control device is configured to calculate a torque increase amount correction amount based on the target acceleration increase amount, calculate a request engine torque based on the basic accelerator request torque and the torque increase amount correction amount, calculate a request injection amount based on the request engine torque, and control a fuel injection valve based on the request injection amount. The relations are such that as a present operating state is close to a constraint, a ratio of the target acceleration increase amount and the accelerator opening degree increase amount becomes smaller.

3 Claims, 7 Drawing Sheets

(56) References Cited

FOREIGN PATENT DOCUMENTS

| | | | |
|---|---|---|---|
| JP | 10-009018 | A | 1/1998 |
| JP | 2005-233088 | | 9/2005 |
| JP | 2009-209899 | A | 9/2009 |
| JP | 2011-038477 | A | 2/2011 |
| JP | 2012-148712 | A | 8/2012 |
| JP | 2015-17571 | | 1/2015 |

* cited by examiner

CONTROL DEVICE FOR INTERNAL COMBUSTION ENGINE

BACKGROUND

Field of the Disclosure

The present disclosure relates to a control device for an internal combustion engine having a fuel injection valve and an accelerator opening degree sensor, Background Art Conventionally, an electronically controlled throttle device having an accelerator opening degree sensor has been known. As an example of an electronically controlled throttle device of this kind, the electronically controlled throttle device described in JP 2005-233088 A may be cited, for example.

In the electronically controlled throttle device described in JP 2005-233088 A, a torque limiter is operated when the change amount of accelerator request torque is large, and a target torque is limited. As a result, worsening of response and occurrence of shock due to a torque level difference are restrained.

Further, JP 2015-017571 A discloses that a target acceleration characteristic is set in advance based on an accelerator opening degree and a vehicle speed, and that as the vehicle speed is lower, a larger target acceleration is set.

SUMMARY OF THE DISCLOSURE

Although JP 2005-233088 A describes the feature in which the target torque is limited, JP 2005-233088 A does not describe a constraint under which an acceleration does not increase even when a driver increases the accelerator opening degree.

Examples of the constraint under which the acceleration does not increase even when the driver increases the accelerator opening degree include a torque constraint under which torque that is actually outputted does not increase even when a request torque is increased, a smoke emission amount constraint under which a fuel injection amount does not increase even when the driver increases the accelerator opening degree to avoid the smoke emission amount reaching a predetermined value or more, and the like.

When the present operating state is close to the constraint, and the driver increases the accelerator opening degree, if any countermeasure for preventing the driving state from reaching the constraint is not performed, a target acceleration increase amount of a large value is set, as a result which, the driving state reaches the constraint, and the acceleration is unlikely to increase even when the driver increases the accelerator opening degree.

In the light of the aforementioned problem, an object of the present disclosure is to provide a control device for an internal combustion engine capable of reducing a fear that an acceleration does not increase even when a driver increases an accelerator opening degree.

According to a first aspect of an embodiment of the present disclosure, there is provided a control device for an internal combustion engine including a fuel injection valve, and an accelerator opening degree sensor, the control device including a basic accelerator request torque calculating section calculating a basic accelerator request torque based on an accelerator opening degree detected by the accelerator opening degree sensor, and a target acceleration increase amount calculating section calculating a target acceleration increase amount based on a relation of the target acceleration increase amount and an accelerator opening degree increase amount, wherein the control device calculates a torque increase amount correction amount based on the target acceleration increase amount, calculates a request engine torque based on the basic accelerator request torque and the torque increase amount correction amount, calculates a request injection amount based on the request engine torque, and controls the fuel injection valve based on the request injection amount, and the relation of the target acceleration increase amount and the accelerator opening degree increase amount, which is used in calculation of the target acceleration increase amount, is such that as a present operating state is closer to a constraint, a ratio of the target acceleration increase amount and the accelerator opening degree increase amount becomes smaller.

That is, in the control device for an internal combustion engine according to the first aspect discussed above, in order to calculate the target acceleration increase amount, the relations of the target acceleration increase amount and the accelerator opening degree increase amount, with ratios of the target acceleration increase amount and the accelerator opening degree increase amount differing from one another, are used in accordance with whether or not the present operating state is close to the constraint.

When the present operating state is not close to the constraint, even if the acceleration is increased quickly, the operating state is unlikely to reach the constraint.

In the light of this point, in the control device for an internal combustion engine according to the first aspect discussed above, in the case where the present operating state is not close to the constraint, the relation of the target acceleration increase amount and the accelerator opening degree increase amount, with the ratio of the target acceleration increase amount and the accelerator opening degree increase amount being large is used. Consequently, when the driver increases the accelerator opening degree, the target acceleration increase amount of a large value is calculated. As a result, the acceleration can be increased quickly in accordance with the acceleration request by the driver.

Meanwhile, if the acceleration is increased quickly when the present operating state is close to the constraint, the operating state is likely to reach the constraint. When the operating state reaches the constraint, the acceleration does not increase even when the driver increases the accelerator opening degree.

In the light of the above point, in the control device for an internal combustion engine according to the first aspect discussed above, the relation of the target acceleration increase amount and the accelerator opening degree increase amount, with the ratio of the target acceleration increase amount and the accelerator opening degree increase amount being small, is used when the present operating state is close to the constraint. Consequently, when the driver increases the accelerator opening degree, the target acceleration increase amount of a small value is calculated. As a result, the acceleration can be gradually increased, whereby in the time period of acceleration request by the driver, the acceleration can be continuously increased without causing the operating state to reach the constraint.

That is, the control device for an internal combustion engine according to the first aspect discussed above can reduce the fear that the acceleration does not increase even when the driver increases the accelerator opening degree as the operating state reaches the constraint.

In other words, the control device for an internal combustion engine according to the first aspect discussed above can realize increase of the acceleration that satisfies the acceleration request by the driver even when the present operating state is close to the constraint.

By the earnest study of the present inventor, it has been found out that responsiveness of the acceleration increase, which is realized to the accelerator opening degree increase operation by the driver is enhanced when the relation of the target acceleration increase amount and the accelerator opening degree increase amount is set based on the relation in which the ratio of the accelerator opening degree increase amount and the accelerator opening degree is proportional to the ratio of the target acceleration increase amount and the target acceleration.

In the light of the above point, according to a second aspect of an embodiment of the present disclosure, there is provided the control device for an internal combustion engine according to the first aspect discussed above wherein the relation of the target acceleration increase amount and the accelerator opening degree increase amount is set based on a relation in which a ratio of the accelerator opening degree increase amount and the accelerator opening degree is proportional to a ratio of the target acceleration increase amount and a target acceleration.

Consequently, in the control device for an internal combustion engine according to the second aspect discussed above, responsiveness of the acceleration increase which is realized to the accelerator opening degree increase operation by the driver can be enhanced more than in the case where the relation of the target acceleration increase amount and the accelerator opening degree increase amount is set based on the relation in which the ratio of the accelerator opening degree increase amount and the accelerator opening degree is not proportional to the ratio of the target acceleration increase amount and the target acceleration.

According to a third aspect of an embodiment of the present disclosure, there is provided the control device for an internal combustion engine according to the first aspect discussed above, wherein an increase amount per accelerator opening degree increase amount, of the request injection amount calculated by the control device at a time of accelerator opening degree increase becomes smaller as the present operating state is closer to the constraint.

That is, in the control device for an internal combustion engine according to the third aspect discussed above, the request injection amount with the increase amount per accelerator opening degree increase amount being small is calculated at the time of accelerator opening degree increase when the present operating state is close to the constraint.

Consequently, in the control device for an internal combustion engine according to the third aspect discussed above, the fuel injection amount can be reduced more, and fuel efficiency can be enhanced more than in the case where the request injection amount with the increase amount per accelerator opening degree increase amount being large is calculated at the time of accelerator opening degree increase and the operating state reaches the constraint.

According to the first aspect discussed above, the possibility that the acceleration does not increase even when the driver increases the accelerator opening degree can be reduced.

According to the second aspect discussed above, the responsiveness of the acceleration increase, which is realized to the accelerator opening degree increase operation by the driver can be enhanced.

According to the third aspect discussed above, the fuel injection amount is reduced, and fuel efficiency can be enhanced.

DETAILED DESCRIPTION OF THE PREFERRED EMBODIMENTS

Figure 1:
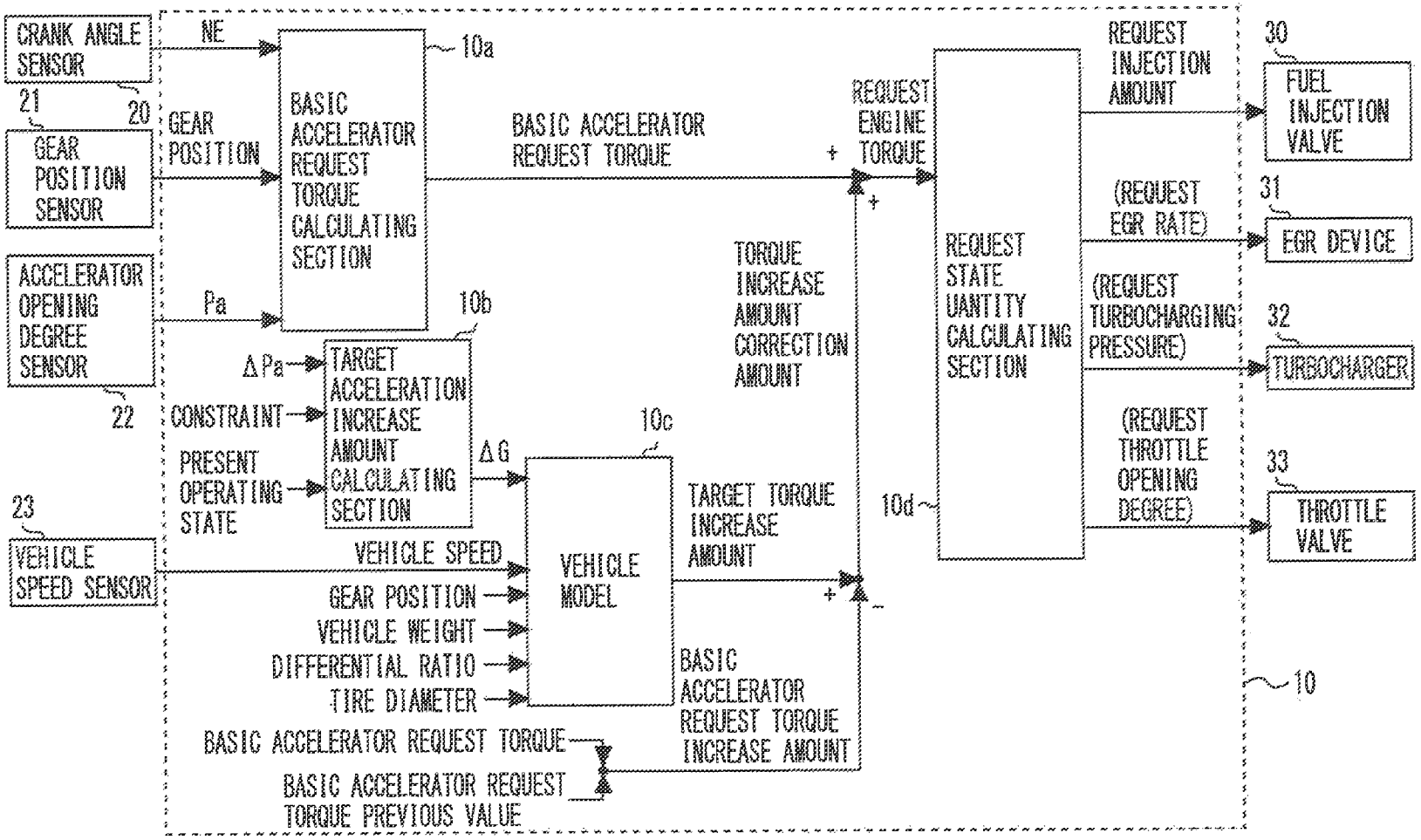
FIG. 1 is a schematic block diagram of an engine system to which a control device for an internal combustion engine of a first embodiment is applied.

Hereinafter, a first embodiment of a control device for an internal combustion engine of the present disclosure will be described. FIG. 1 is a schematic block diagram of an engine system to which the control device for an internal combustion engine of the first embodiment is applied.

In an example illustrated in FIG. 1 of the engine system to which the control device for an internal combustion engine of the first embodiment is applied, a crank angle sensor 20, a gear position sensor 21, an accelerator opening degree sensor 22, a vehicle speed sensor 23, a control device (ECU) 10, a fuel injection valve 30, an EGR device 31, a turbocharger 32 and a throttle valve 33 are provided.

The control device 10 is provided with a basic accelerator request torque calculating section 10*a* calculating a basic accelerator request torque [Nm], a target acceleration increase amount calculating section 10*b* calculating a target acceleration increase amount $\Delta G$ [m/s$^2$], and a vehicle model 10*c* calculating a target torque increase amount [Nm]. Further, in a request state quantity calculating section 10*d* provided in the control device 10, a request injection amount [mm3/st], a request turbocharging pressure [kPa], a request EGR rate [–] and a request throttle opening degree [%] are calculated.

Figure 2:
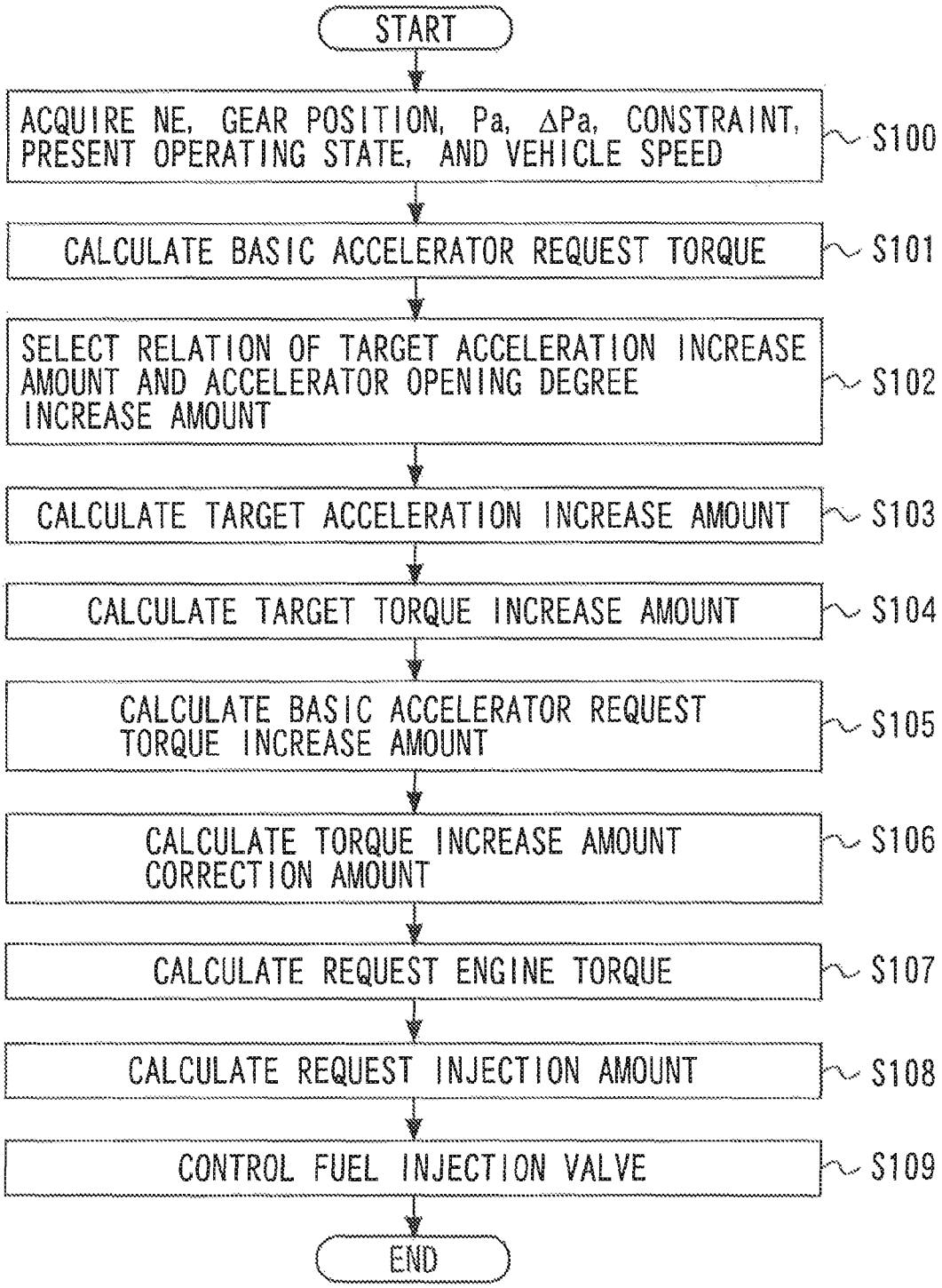
FIG. 2 is a flowchart for explaining control of a fuel injection valve 30 and the like, which is executed at a time of accelerator opening degree increase in the engine system illustrated in FIG. 1.

FIG. 2 is a flowchart for explaining control of the fuel injection valve 30 and the like, which is executed at a time of accelerator opening degree increase in the engine system illustrated in FIG. 1. A routine illustrated in FIG. 2 is executed at predetermined time intervals.

When the routine illustrated in FIG. 2 is started, first of all in step S100, the engine speed NE [rpm] calculated based on an output signal of the crank angle sensor 20 (refer to FIG. 1) is acquired, and is inputted to the basic accelerator request torque calculating section 10*a* (refer to FIG. 1). Further, a gear position detected by the gear position sensor 21 (refer to FIG. 1) is acquired, and is inputted to the basic accelerator request torque calculating section 10*a* and the vehicle model 10*c*.

In the example illustrated in FIG. 1 of the engine system to which the control device for an internal combustion engine of the first embodiment is applied, the gear position detected by the gear position sensor 21 is inputted to the basic accelerator request torque calculating section 10*a* and the vehicle model 10*c*, whereas in another example, instead, a gear position estimated based on a gear ratio calculated from the engine speed NE and a vehicle speed [km/h] can be inputted to the basic accelerator request torque calculating section 10*a* and the vehicle model 10*c*.

As illustrated in FIG. 2, in step S100, an accelerator opening degree Pa [%] calculated based on en output signal of the accelerator opening degree sensor 22 (refer to FIG. 1) is further acquired, and is inputted to the basic accelerator request torque calculating section 10*a* (refer to FIG. 1). Further, an accelerator opening degree increase amount (a difference between the accelerator opening degree Pa that is acquired when the routine illustrated in FIG. 2 is executed this time, and the accelerator opening degree Pa that is acquired when the routine illustrated in FIG. 2 is executed a previous time, for example) that is calculated based on the accelerator opening degree Pa is acquired, and inputted to the target acceleration increase amount calculating section 10*b* (refer to FIG. 1).

Further, in step S100, a constraint under which an acceleration G [m/s$^2$] does not increase even when the driver increases the accelerator opening degree Pa is acquired, and is inputted to the target acceleration increase amount calculating section 10*b*.

In the example illustrated in FIGS. 1 and 2 of the engine system to which the control device for an internal combustion engine of the first embodiment is applied, a torque constraint TR (refer to FIGS. 5B and 6B) under which a torque that is actually outputted does not increase even when a request torque is increased is used, as a constraint inputted to the target acceleration increase amount calculating section 10*b*.

As illustrated in FIG. 2, in step S100, a present operating state is further acquired, and is inputted to the target acceleration increase amount calculating section 10*b* (refer to FIG. 1).

In the example illustrated in FIGS. 1 and 2 of the engine system to which the control device for an internal combustion engine of the first embodiment is applied, as the present operating state which is inputted to the target acceleration increase amount calculating section 10*b*, a request engine torque (refer to FIG. 1, FIG. 5H and FIG. 6H) is used, for example.

As illustrated in FIG. 2, in step S100, the vehicle speed [km/h] calculated based on an output signal of the vehicle speed sensor 23 (refer to FIG. 1) is further acquired, and is inputted to the vehicle model 10*c* (refer to FIG. 1). Further, a vehicle weight [kg], a differential ratio [−], and a tire diameter [m] are inputted to the vehicle model 10*c*.

Next, in step S101, the basic accelerator request torque is calculated based on the engine speed NE, the gear position and the accelerator opening degree Pa by the basic accelerator request torque calculating section 10*a* (refer to FIG. 1).

Figure 3:
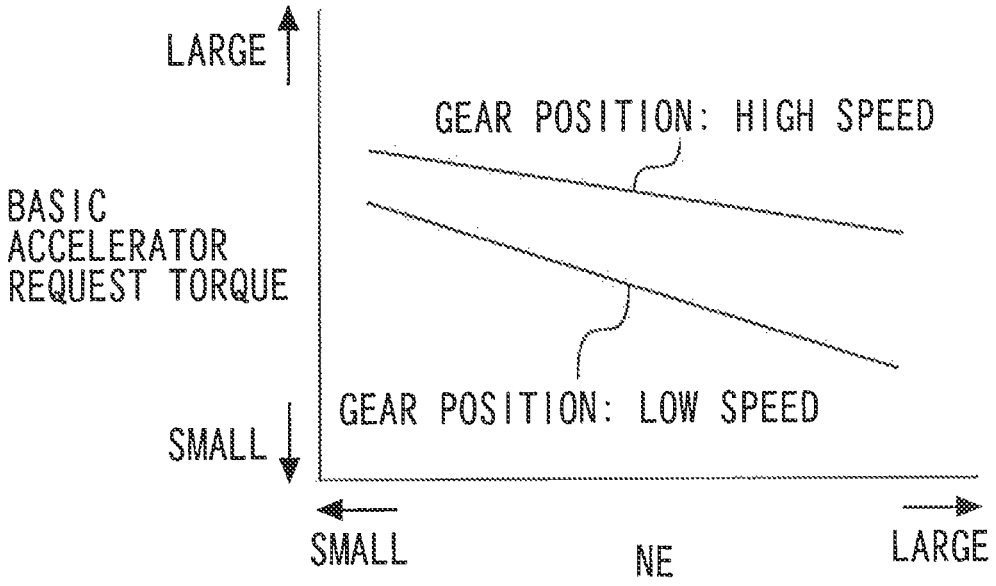
FIG. 3 is a diagram illustrating a relation of a basic accelerator request torque, an engine speed NE and a gear position.

FIG. 3 is a diagram illustrating a relation of the basic accelerator request torque, the engine speed NE and the gear position. As illustrated in FIG. 3, as the engine speed NE is higher, a value of the basic accelerator request torque calculated by the basic accelerator request torque calculating section 10*a* becomes smaller. Further, as the gear position is higher, a change amount of the basic accelerator request torque per unit change amount of the engine speed NE becomes smaller per unit change amount.

Further, as the accelerator opening degree Pa is larger, the value of the basic accelerator request torque calculated by the basic accelerator request torque calculating section 10*a* becomes larger.

Figure 4:
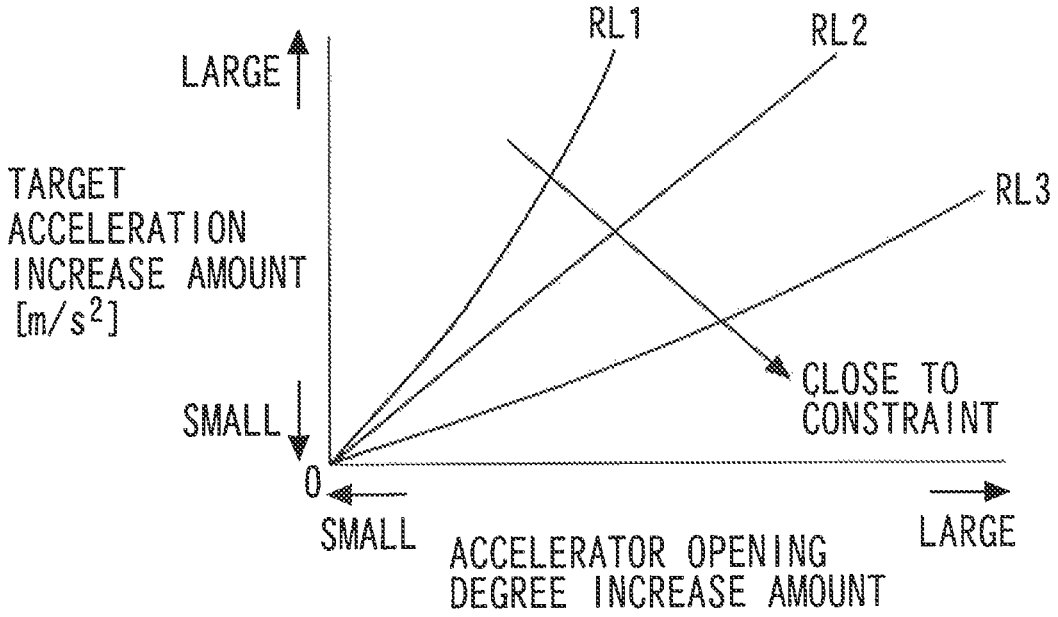
FIG. 4 is a diagram illustrating a relation of relations RL1, RL2 and RL3 between a target acceleration increase amount $\Delta G$ [m/s$^2$] and an accelerator opening degree increase amount $\Delta Pa$ [%]

FIG. 4 is a diagram illustrating a relation of relations RL1, RL2 and RL3 of the target acceleration increase amount ΔG [m/s$^2$] and the accelerator opening degree increase amount ΔPa [%].

In an example illustrated in FIG. 4 of the engine system to which the control device for an internal combustion engine of the first embodiment is applied, the relation RL1 in which a ratio of the target acceleration increase amount ΔG and the accelerator opening degree increase amount ΔPa is large, the relation RL2 in which the ratio of the target acceleration increase amount ΔG and the accelerator opening degree increase amount ΔPa is smaller than in the relation RL1, and the relation RL3 in which the ratio of the target acceleration increase amount ΔG and the accelerator opening degree increase amount ΔPa is smaller than in the relation RL2 are selectively used. As illustrated in FIG. 4, the relations RL1, RL2 and RL3 are set so that when a value of the accelerator opening degree increase amount ΔPa is zero, a value of the target acceleration increase amount ΔG becomes zero.

In the example illustrated in FIG. 2 of the engine system to which the control device for an internal combustion engine of the first embodiment is applied, in step S102, one of the three relations RL1, RL2 and RL3 illustrated in FIG. 4 is selected based on the present operating state (the request engine torque) and the constraint (the torque constraint).

More specifically, in the example illustrated in FIGS. 1 to 4 of the engine system to which the control device for an internal combustion engine of the first embodiment is applied, the relation RL1 in which the ratio of the target acceleration increase amount ΔG and the accelerator opening degree increase amount ΔPa is large is selected in step S102, when the present operating state (the request engine torque (refer to FIG. 5H)) is not close to the constraint (the torque constraint TR (refer to FIG. 5H)).

When the present operating state (the request engine torque (refer to FIG. 6H)) is close to the constraint (the torque constraint TR (refer to FIG. 6H)), the relation RL3 in which the ratio of the target acceleration increase amount ΔG and the accelerator opening degree increase amount ΔPa is small is selected in step S102.

When the present operating state (the request engine torque) is relatively close to the constraint (the torque constraint) although the present operating state is not so close to the constraint as in the case where the relation RL3 is selected, and the operating state (the request engine torque) is likely to reach the constraint (the torque constraint) if the acceleration is increased quickly, the relation RL2 in which the ratio of the target acceleration increase amount ΔG and the accelerator opening degree increase amount ΔPa is smaller than in the relation RL1 is selected.

In the example illustrated in FIG. 4 of the engine system to which the control device for an internal combustion engine of the first embodiment is applied, the three relations RL1, RL2 and RL3 are selectively used, whereas in another example, a plurality of optional relations other than the three relations can be also used selectively instead.

As illustrated in FIG. 2, next in step S103, the target acceleration increase amount ΔG [m/s$^2$] is calculated by the target acceleration increase amount calculating section 10*b* (refer to FIG. 1) based on one of the three relations RL1, RL2 and RL3 that is selected in step S102, and the accelerator opening degree increase amount ΔPa.

Next, in step S104, the target torque increase amount [Nm] is calculated by the vehicle model 10*c* (refer to FIG. 1).

As the target acceleration increase amount ΔG is larger, the target torque increase amount calculated by the vehicle model 10*c* becomes larger. As the vehicle speed is larger, friction becomes larger, and thus the value of the target torque increase amount becomes larger. As the gear position is higher, the gear ratio becomes smaller in general, and thus the value of the target torque increase amount becomes large. Further, the value of the target torque increase amount calculated by the vehicle model 10*c* becomes larger as the vehicle weight is larger, becomes larger as the differential ratio is larger, and becomes larger as the tire diameter is larger.

Next, in step S105, a basic accelerator request torque increase amount [Nm] that is a difference between the basic accelerator request torque [Nm] calculated in step S101 when the routine illustrated in FIG. 2 is executed this time, and a basic accelerator request torque previous value [Nm] calculated in step S101 when the routine illustrated in FIG. 2 is executed the previous time is calculated.

Next, in step S106, a torque increase amount correction amount [Nm] is calculated by subtracting the basic accelerator request torque increase amount calculated in step S105 from the target torque increase amount calculated in step S104. A value of the torque increase amount correction amount calculated in step S106 is zero or less.

As illustrated in FIG. 2, subsequently in step S107, a request engine torque that is a total sum of the basic accelerator request torque calculated in step S101 and the torque increase amount correction amount calculated in step S106 is calculated.

Next, in step S108, the request injection amount [mm$^3$/st] is calculated by the request state quantity calculating section 10*d* (refer to FIG. 1).

Next, in step S109, the fuel injection valve 30 is controlled by the control device 10 based on the request injection amount calculated in step S108.

Figure 5:
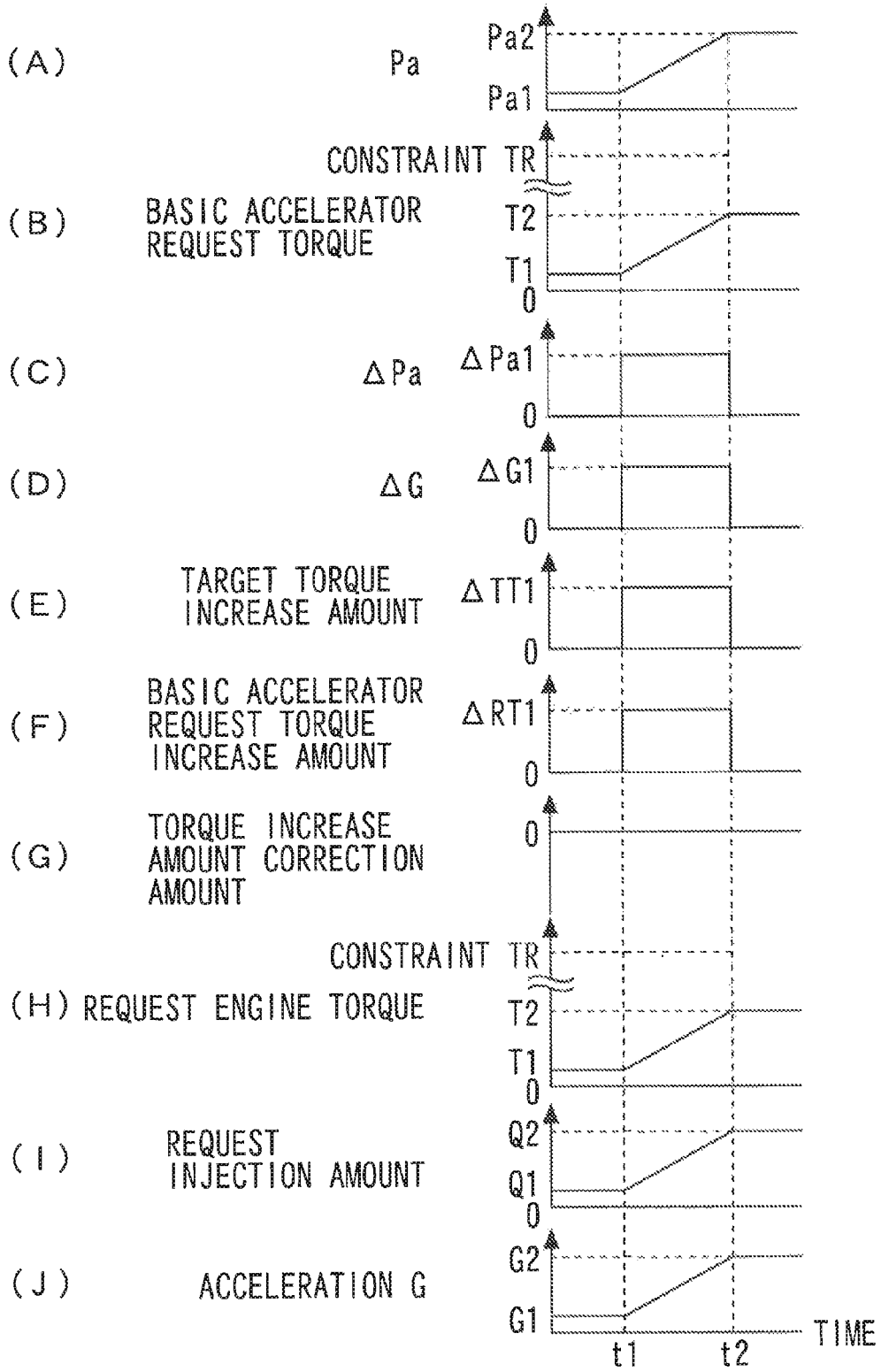
FIG. 5 is a time chart for explaining control at the time of accelerator opening degree increase in a case where a present operating state in the engine system to which the control device for an internal combustion engine of the first embodiment is applied is not close to a constraint.

FIG. 5 is a time chart for explaining control at a time of accelerator opening degree increase in the case where the present operating state in the engine system to which the control device for an internal combustion engine of the first embodiment is applied is not close to the constraint.

In an example illustrated in FIG. 5, as illustrated in FIG. 5A, in a time period from a time t1 to a time t2, the accelerator opening degree Pa increases from a value Pa1 to a value Pa2. As a result, as illustrated in FIG. 5B, the basic accelerator request torque calculated by the basic accelerator request torque calculating section 10*a* (refer to FIG. 1) increases from a value TI to a value T2 in the time period from the time t1 to the time t2.

In the example illustrated in FIG. 5, as illustrated in FIG. 5H, at a time point of the time t1, the present operating state (a value T1 of the request engine torque) is not close to the constraint (the torque constraint TR). Consequently, even if an acceleration G (refer to FIG. 5J) is increased quickly, the operating state (the request engine torque) is unlikely to reach the constraint (the torque constraint TR). In the light of this point, in the engine system to which the control device for an internal combustion engine of the first embodiment is applied, the relation RL1 (refer to FIG. 4) in which the ratio of the target acceleration increase amount ΔG and the accelerator opening degree increase amount ΔPa is large is selected in step S102 (refer to FIG. 4).

Consequently, as illustrated in FIG. 5D, the target acceleration increase amount ΔG calculated based on the relation RL1 and a value ΔPa1 (refer to FIG. 5C) of the accelerator opening degree increase amount ΔPa becomes a large value ΔG1 when the driver increases the accelerator opening degree Pa (the time t1).

In the example illustrated in FIG. 5, the value ΔG1 of the target acceleration increase amount ΔG is large, and thus, as illustrated in FIG. 5E, the target torque increase amount calculated by the vehicle model 10*c* (refer to FIG. 1) at the time point of the time t1 becomes a large value ΔTT1.

In the example illustrated in FIG. 5, as illustrated in FIG. 5E and FIG. 5F, at the time point of the time t1, the value ΔTT1 of the target torque increase amount becomes equal to a value ΔRT1 of the basic accelerator request torque increase amount that is the difference between the basic accelerator request torque calculated when the routine illustrated in FIG. 2 is executed this time, and the basic accelerator request torque previous value calculated when the routine illustrated in FIG. 2 is executed the previous time.

As a result, as illustrated in FIG. 5G, the value of the torque increase amount correction amount calculated by subtracting the value ΔRT1 of the basic accelerator request torque increase amount from the value ΔTT1 of the target torque increase amount becomes zero.

The values illustrated in FIG. 5C, FIG. 5D, FIG. 5E, FIG. 5F and FIG. 5G are differences between the values calculated when the routine illustrated in FIG. 2 is executed this time, and the values calculated when the routine illustrated in FIG. 2 is executed the previous time.

Since in the example illustrated in FIG. 5, the value of the torque increase amount correction amount (refer to FIG. 5G) is zero, the value T1 of the request engine torque at the time point of the time t1 is equal to the value T1 of the basic accelerator request torque (refer to FIG. 5B) at the time point of the time t1, and the value T2 of the request engine torque at the time point of the time t2 is equal to the value T2 of the basic accelerator request torque at the time point of the time t2, as illustrated in FIG. 5H.

Consequently, as illustrated in FIG. 5I, in the time period from the time t1 to the time t2, the request injection amount quickly increases from a value Q1 to a value Q2. As a result, in the engine system to which the control device for an internal combustion engine of the first embodiment is applied, as illustrated in FIG. 5J, in the time period from the time t1 to the time t2, the acceleration G can be quickly increased from a value G1 to a value G2.

Figure 6:
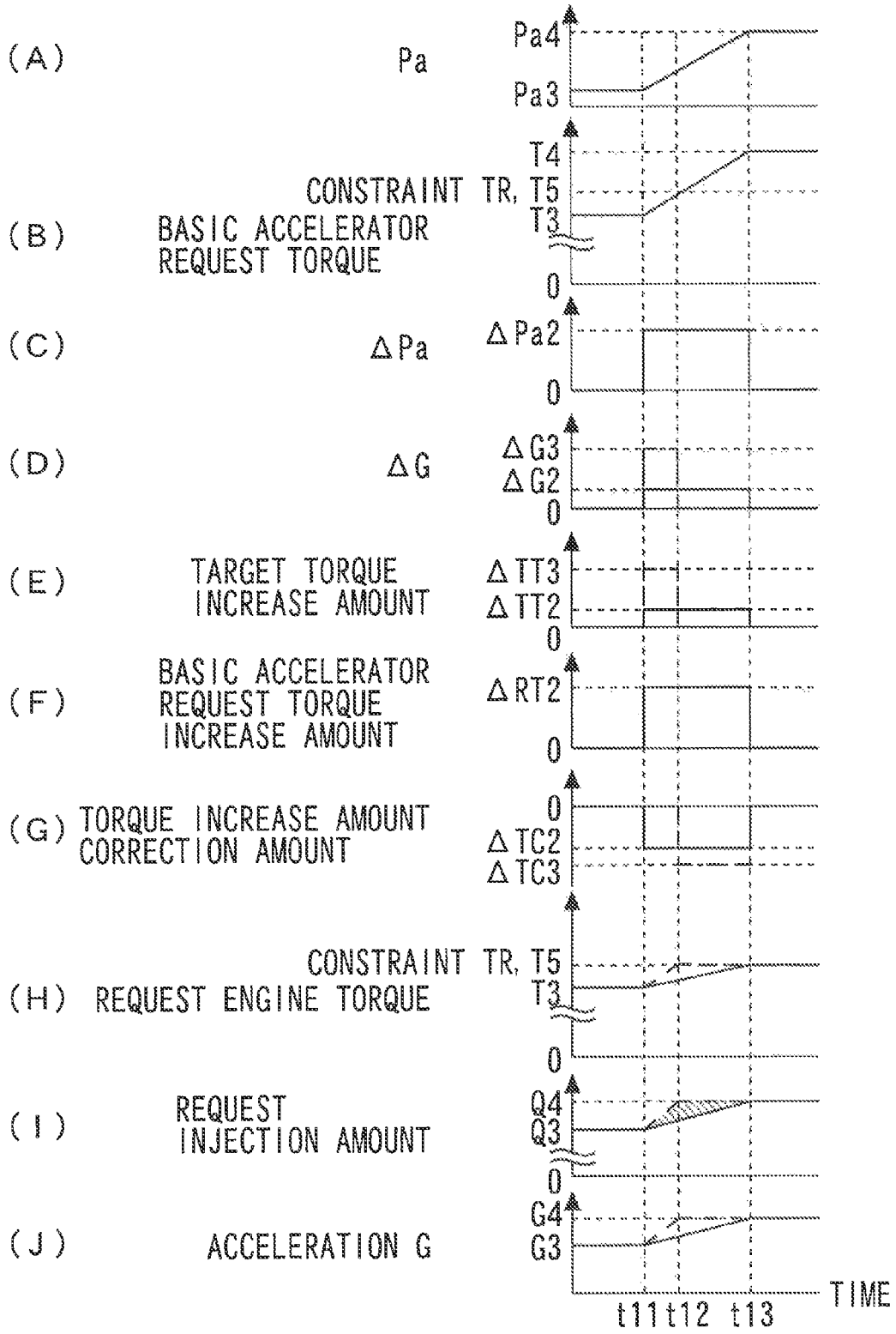
FIG. 6 is a time chart for explaining control at the time of accelerator opening degree increase in a case where the present operating state in the engine system to which the control device for an internal combustion engine of the first embodiment is applied is close to the constraint.

FIG. 6 is a time chart for explaining control at a time of accelerator opening degree increase in the case where the present operating state in the engine system to which the control device for an internal combustion engine of the first embodiment is applied is close to the constraint.

In an example illustrated in FIG. 6, as illustrated in FIG. 6A, in a time period from a time t11 to a time t13, the accelerator opening degree Pa increases from a value Pa3 to a value Pa4. As a result, as illustrated in FIG. 6B, the basic accelerator request torque calculated by the basic accelerator request torque calculating section 10*a* (refer to FIG. 1) increases from a value T3 to a value T4 in the time period from the time t11 to the time t13.

In the example illustrated in FIG. 6, as illustrated in FIG. 6H, at a time point of the time t11, the present operating state (a value T3 of the request engine torque) is close to the constraint (the torque constraint TR). Consequently, if the acceleration G (refer to FIG. 5J) is increased quickly as in the example illustrated in FIG. 5, the operating state (the request engine torque) is likely to reach the constraint (the torque constraint TR). In the light of this point, in the engine system to which the control device for an internal combustion engine of the first embodiment is applied, the relation RL3 (refer to FIG. 4) in which the ratio of the target acceleration increase amount ΔG and the accelerator opening degree increase amount ΔPa is small is selected in step S102 (refer to FIG. 2).

Consequently, as illustrated in FIG. 6D, the target acceleration increase amount ΔG calculated based on the relation RL3 and a value ΔPa2 (refer to FIG. 6C) of the accelerator opening degree increase amount ΔPa becomes a small value ΔG2 when the driver increases the accelerator opening degree Pa (the time t11). (If the value ΔPa1 (refer to FIG. 5C) and the value ΔPa2 (refer to FIG. 6C) are equal to each other, the value ΔG2 (refer to FIG. 6D) becomes smaller than the value ΔG1 (refer to FIG. 5C).)

In the example illustrated in FIG. 6, the value ΔG2 of the target acceleration increase amount ΔG is small, and thus, as illustrated in FIG. 6E, the target torque increase amount calculated by the vehicle model 10*c* (refer to FIG. 1) at the time point of the time t11 becomes a small value ΔTT2.

In the example illustrated in FIG. 6, as illustrated in FIG. 6E and FIG. 6F, at the time point of the time t11, the value ΔTT2 of the target torque increase amount becomes smaller than a value ΔRT2 of the basic accelerator request torque increase amount that is the difference between the basic accelerator request torque calculated when the routine illustrated in FIG. 2 is executed this time and the basic accelerator request torque previous value calculated when the routine illustrated in FIG. 2 is executed the previous time.

As a result, as illustrated in FIG. 6G, the torque increase amount correction amount calculated by subtracting the value ΔRT2 of the basic accelerator request torque increase amount from the value ΔTT2 of the target torque increase amount becomes a negative value ΔTC2.

The values illustrated in FIG. 6C, FIG. 6D, FIG. 6E, FIG. 6F and FIG. 6G are differences between the values calculated when the routine illustrated in FIG. 2 is executed this time, and the values calculated when the routine illustrated in FIG. 2 is executed the previous time.

Since in the example illustrated in FIG. 6, the torque increase amount correction amount (refer to FIG. 6G) becomes the negative value ΔTC2 after the time t11, the value of the request engine torque at the time point after the time t11 becomes smaller than the value of the basic accelerator request torque (refer to FIG. 6B) at the time point after the time t11, as illustrated in FIG. 6H. In more detail, a value T5 (≤the torque constraint TR) of the request engine torque at the time point of the time t13 becomes smaller than a value T4 (>the torque constraint TR) of the basic accelerator request torque at the time point of the time t13.

Consequently, as illustrated in FIG. 61, in the time period from the time t11 to the time t13, the request injection amount gradually increases from a value Q3 to a value Q4. As a result, in the engine system to which the control device for an internal combustion engine of the first embodiment is applied, as illustrated in FIG. 6J, in the time period from the time t11 to the time t13, the acceleration G can be gradually increased from a value G3 to a value 34.

Thereby, in the engine system to which the control device for an internal combustion engine of the first embodiment is applied, as illustrated in FIG. 6H and FIG. 6J, in an acceleration request time period (in the time period from the time t11 to the time t13) by the driver, the acceleration G can be increased continuously without causing the operating state (the request engine torque (refer to FIG. 6H)) to reach the constraint (the torque constraint TR).

That is, in the engine system to which the control device for an internal combustion engine of the first embodiment is applied, increase of the acceleration G that satisfies the acceleration request by the driver can be realized even when the present operating state (the value T3 of the request engine torque at the time point of the time t11) is close to the constraint (the torque constraint TR).

Next, control at a time of accelerator opening degree increase in a case where a present operating state is close to the constraint in an engine system of a comparative example will be described.

In the engine system of the comparative example, as in the engine system to which the control device for an internal combustion engine of the first embodiment is applied, the accelerator opening degree Pa increases from the value Pa3 to the value Pa4, in the time period from the time t11 to the time t13, as illustrated in FIG. 6A. As a result, as illustrated in FIG. 6B, the basic accelerator request torque calculated by the basic accelerator request torque calculating section 10*a* (refer to FIG. 1) increases from the value T3 to the value T4 in the time period from the time t11 to the time t13.

In the engine system of the comparative example, the relations RL2 and RL3 (refer to FIG. 4) in each of which the ratio of the target acceleration increase amount ΔG and the accelerator opening degree increase amount ΔPa is small are not included in the target acceleration increase amount calculating section 10*b* (refer to FIG. 1), but only the relation RL1 (refer to FIG. 4) in which the ratio of the target acceleration increase amount ΔG and the accelerator opening degree increase amount ΔPa is large is included in the target acceleration increase amount calculating section 10*b*.

Consequently, in the engine system of the comparative example, the relation RL1 (refer to FIG. 4) in which the ratio of the target acceleration increase amount ΔG and the accelerator opening degree increase amount ΔPa is large is selected in step S102 (refer to FIG. 2), although at the time point of the time t11, the present operating state (the value T3 of the request engine torque) is close to the constraint (the torque constraint TR) as illustrated in FIG. 6H, and if the acceleration G (refer to FIG. 6J) is increased quickly, the operating state (the request engine torque) is likely to reach the constraint (the torque constraint TR).

As a result, as illustrated in FIG. 6D by the broken line, the target acceleration increase amount ΔG calculated based on the relation RL1 and the value ΔPa2 (refer to FIG. 6C) of the accelerator opening degree increase amount ΔPa becomes a large value ΔG3 when the driver increases the accelerator opening degree Pa (the time t11). (If the value ΔPa1 (refer to FIG. 5C) and the value ΔPa2 (refer to FIG. 6C) are equal to each other, the value ΔG3 (refer to FIG. 6D) becomes equal to the value ΔG1 (refer to FIG. 5D.))

In the engine system of the comparative example, the value ΔG3 of the target acceleration increase amount ΔG at the time point of the time t11 is large, and thus, as illustrated in FIG. 6E by the broken line, the target torque increase amount calculated by the vehicle model 10*c* (refer to FIG. 1) at the time point of the time t11 also becomes a large value ΔTT3.

In the engine system of the comparative example, as illustrated in FIG. 6E by the broken line, at the time point of the time t11, the value ΔTT3 of the target torque increase amount becomes equal to a value ΔRT2 (refer to FIG. 6F) of the basic accelerator request torque increase amount that is the difference between the basic accelerator request torque calculated when the routine illustrated in FIG. 2 is executed this time and the basic accelerator request torque previous value calculated when the routine illustrated in FIG. 2 is executed the previous time.

As a result, as illustrated in FIG. 6G by the broken line, at the time point of the time t11, the value of the torque increase amount correction amount calculated by subtracting the value ΔRT2 of the basic accelerator request torque increase amount from the value ΔTT3 of the target torque increase amount becomes zero, The values illustrated by the broken lines in FIG. 6D, FIG. 6E and FIG. 6G are differences between the values calculated when the routine illustrated in FIG. 2 is executed this time, and the values calculated when the routine illustrated in FIG. 2 is executed the previous time.

Since in the engine system of the comparative example, the value of the torque increase amount correction amount (refer to FIG. 6G) at the time point of the time t11 becomes zero, the value T3 of the request engine torque at the time point of the time t11 becomes equal to the value T3 of the basic accelerator request torque (refer to FIG. 6B) at the time point of the time t11, as illustrated by the broken line in FIG. 6H.

Further, in the engine system of the comparative example, the value of the torque increase amount correction amount (refer to FIG. 6G) in the time period from the time t11 to a time t12 also becomes zero, and therefore, as shown in FIG. 6H by the broken line, a value T5 of the request engine torque at the time point of the time t12 becomes equal to the value T5 of the basic accelerator request torque (refer to FIG. 6B) at the time point of the time t12.

Consequently, in the time period from the time t11 to the time t12, the request injection amount increases quickly from a value Q3 to a value Q4 as illustrated by the broken line in FIG. 6I, and the acceleration G increases quickly from a value G3 to a value G4, as illustrated by the broken line in FIG. 6J.

However, in the engine system of the comparative example, the operating state (the request engine torque) reaches the constraint (the torque constraint TR) at the time t12 before the time t13, and the request engine torque does not increase as illustrated by the broken line in FIG. 6H, although the driver increases the accelerator opening degree Pa and issues an acceleration request in the time period from the time t11 to the time t13 as shown in FIG. 6A and FIG. 6C.

That is, in the engine system of the comparative example, the request engine torque (refer to FIG. 6H) is limited to the fixed value T5 (=the torque constraint TR) by the constraint (the torque constraint TR) inputted to the target acceleration increase amount calculating section 10*b* (refer to FIG. 1), although the accelerator opening degree Pa (refer to FIG. 6A) also increases, and with this, the basic accelerator request torque (refer to FIG. 6B) increases in the time period from the time t12 to the time t13.

As a result, in the engine system of the comparative example, the acceleration G is limited to the fixed value G4 as illustrated by the broken line in FIG. 6J although the driver issues the acceleration request in the time period from the time t12 to the time t13, and the increase of the acceleration G which satisfies the acceleration request of the driver cannot be realized.

In more detail, in the engine system of the comparative example, the value of the target acceleration increase amount ΔG (refer to FIG. 6D) is limited to zero in the time period from the time t12 to the time t13 by the constraint (the torque constraint TR) inputted to the target acceleration increase amount calculating section 10*b* (refer to FIG. 1). As a result, the value of the target torque increase amount (refer to FIG. 6E) becomes zero, and the torque increase amount correction amount (refer to the broken line in FIG. 6G) calculated by subtracting the value ΔRT2 of the basic accelerator request torque increase amount (refer to FIG. 6F) from the value (zero) of the target torque increase amount becomes the negative value ΔTC3.

In other words, in the engine system to which the control device for an internal combustion engine of the first embodiment is applied, the relation RL3 (refer to FIG. 4) of the target acceleration increase amount ΔG and the accelerator opening degree increase amount ΔPa, in which the ratio of the target acceleration increase amount ΔG and the accelerator opening degree increase amount ΔPa is small, which is selected in step S102 (refer to FIG. 2) is used in step S103 (refer to FIG. 2), when the present operating state (the request engine torque (refer to FIG. 6H)) is close to the constraint (the torque constraint TR (refer to FIG. 6H)). Consequently, when the driver increases the accelerator opening degree (the time t11 (refer to FIG. 6)), the target acceleration increase amount. ΔG (refer to FIG. 6D) of the small value ΔG2 is calculated. As a result, the acceleration G (refer to FIG. 6J) can be gradually increased, whereby during an acceleration request time period by the driver (during the time period from the time t11 to the time t13), the acceleration G can be continuously increased without causing the operating state (the request engine torque (refer to FIG. 6H)) to reach the constraint (the torque constraint TR).

That is, the engine system to which the control device for an internal combustion engine of the first embodiment is applied can reduce the possibility that the acceleration G (refer to FIG. 6J) does not increase even if the driver increases the accelerator opening degree Pa (refer to FIG. 6A) with the operating state (the request engine torque (refer to FIG. 6H)) reaching the constraint (the torque constraint TR) as in the time period from the time t12 to the time t13 in the comparative example illustrated by the broken lines in FIG. 6.

That is, the engine system to which the control device for an internal combustion engine of the first embodiment is applied can realize increase of the acceleration G (refer to FIG. 6J) that satisfies the acceleration request by the driver, as in the time period from the time t11 to the time t13 in the example illustrated by the solid line in FIG. 6, even when the present operating state (the request engine torque (refer to FIG. 6H)) is close to the constraint (the torque constraint TR (refer to FIG. 6H)).

By the earnest study of the present inventor, it has been found out that responsiveness of the acceleration increase that is realized to an accelerator opening degree increasing operation by the driver is enhanced, when the relations RL1, RL2 and RL3 (refer to FIG. 4) of the target acceleration increase amount ΔG and the accelerator opening degree increase amount ΔPa are set, based on a relation $((\Delta Pa/Pa) \propto (\Delta G/G))$ in which the ratio (ΔPa/Pa) of the accelerator opening degree increase amount ΔPa (refer to FIG. 4, FIG. 5C and FIG. 6C) and the accelerator opening degree Pa (refer to FIG. 5A and FIG. 6A) is proportional to the ratio (ΔG/G) of the target acceleration increase amount ΔG (refer to FIG. 4, FIG. 5D and FIG. 6D) and the target acceleration G (refer to FIG. 5J and FIG. 6J).

In the light of the above point, in the engine system to which the control device for an internal combustion engine of the first embodiment is applied, the relations RL1, RL2 and RL3 of the target acceleration increase amount ΔG and the accelerator opening degree increase amount ΔPa are set, based on the relation ((ΔPa/Pa) ∝ (ΔG/G)) in which the ratio (ΔPa/Pa) of the accelerator opening degree increase amount ΔPa and the accelerator opening degree Pa is proportional to the ratio (ΔG/G) of the target acceleration increase amount ΔG and the target acceleration G.

Consequently in the engine system to which the control device for an internal combustion engine of the first embodiment is applied, responsiveness of the acceleration increase, which is realized to the accelerator opening degree increasing operation by the driver can be enhanced more than in a case where the relation of the target acceleration increase amount ΔG and the accelerator opening degree increase amount ΔPa is set, based on a relation in which the ratio (ΔPa/Pa) of the accelerator opening degree increase amount ΔPa and the accelerator opening degree Pa is not proportional to the ratio (ΔG/G) of the target acceleration increase amount ΔG and the target acceleration G.

As described above, in the example illustrated in FIG. 5 of the engine system to which the control device for an internal combustion engine of the first embodiment is applied, the present operating state (the value T1 of the request engine torque (refer to FIG. 5H)) is not close to the constraint (the torque constraint TR) at the time point of the time T1. Therefore, by using the relation RL1 (refer to FIG. 4) in which the ratio of the target acceleration increase amount ΔG and the accelerator opening degree increase amount ΔPa is large in step S103 (refer to FIG. 2), at the time of accelerator opening degree increase from the time t1 to the time t2, the target acceleration increase amount ΔG with an increase amount per accelerator opening degree increase amount ΔPa being large is calculated. Further, the torque increase amount correction amount (the value is zero) is calculated in step S106 (refer to FIG. 2) based on the target acceleration increase amount ΔG calculated in step S103. Further, the request engine torque (the value is equal to the value of the basic accelerator request torque) is calculated in step S107 (refer to FIG. 2), based on the basic accelerator request torque calculated in step S101 (refer to FIG. 2) and the torque increase amount correction amount calculated in step S106. Further, based on the request engine torque calculated in step S107, the request injection amount (refer to FIG. 5I) with an increase amount per accelerator opening degree increase amount ΔPa being large is calculated in step S108 (refer to FIG. 2).

Meanwhile, in the example illustrated by the solid lines in FIG. 6 of the engine system to which the control device for an internal combustion engine of the first embodiment is applied, the present operating state (the value T3 of the request engine torque (refer to FIG. 6H)) is close to the constraint (the torque constraint TR) at the time point of the time t11. Consequently, by using the relation RL3 (refer to FIG. 4) in which the ratio of the target acceleration increase amount ΔG and the accelerator opening degree increase amount ΔPa is small in step S103 at the time of accelerator opening degree increase from the time t11 to the time t13, the target acceleration increase amount ΔG with the increase amount per accelerator opening degree increase amount ΔPa being small is calculated. Further, based on the target acceleration increase amount ΔG calculated in step S103, the torque increase amount correction amount (the value is a negative value) is calculated in step S106. Further, the request engine torque (the value is smaller than the value of the basic accelerator request torque) is calculated in step S107, based on the basic accelerator request torque calculated in step S101, and the torque increase amount correction amount calculated in step S106. Further, based on the request engine torque calculated in step S107, the request injection amount (refer to FIG. 6I) with the increase amount per accelerator opening degree increase amount ΔPa is calculated in step S108.

In the comparative example illustrated by the broken lines in FIG. 6, the relation RL1 (refer to FIG. 4) in which the ratio of the target acceleration increase amount ΔG and the accelerator opening degree increase amount ΔPa is large is used at the time of accelerator opening degree increase, although the present operating state (the value T3 of the request engine torque (refer to FIG. 6H)) is close to the constraint (the torque constraint TR) at the time point of the time t11. Consequently, the request injection amount (refer to FIG. 6I) with the increase amount per accelerator opening degree increase amount ΔPa being large is calculated in the time period from the time t11 to the time t12, and as a result, the operating state (the request engine torque (refer to FIG. 6H)) reaches the constraint (the torque constraint TR) at the time t12.

In other words, in the engine system to which the control device for an internal combustion engine of the first embodiment is applied, the request injection amount (refer to FIG. 6I) with the increase amount per accelerator opening degree increase amount being small is calculated at the time of accelerator opening degree increase (in the time period from the time t11 to the time t13) when the present operating state (the value T3 of the request engine torque (refer to FIG. 6H)) is close to the constraint (the torque constraint TR), as shown by the solid lines in FIG. 6.

That is, in the engine system to which the control device for an internal combustion engine of the first embodiment is applied, the increase amount per accelerator opening degree increase amount of the request injection amount (refer to FIG. 5I and FIG. 6I) calculated by the control device 10 (refer to FIG. 1) at the time of accelerator opening degree increase (in the time period from the time t1 to the time t2 in FIG. 5, and in the time period from the time t11 to the time t13 in FIG. 6) is smaller as the present operating state (the request engine torque (refer to FIG. 5H and FIG. 6H)) is closer to the constraint (the torque constraint TR).

Consequently, in the engine system to which the control device for an internal combustion engine of the first embodiment is applied, the fuel injection amount can be reduced by the amount illustrated by hatching in FIG. 6I, and fuel efficiency can be enhanced more than in the comparative example illustrated by the broken lines in FIG. 6 in which the request injection amount (refer to the broken line in FIG. 6I) with the increase amount per accelerator opening degree increase amount being large is calculated at the time of accelerator opening degree increase (in the time period from the time t11 to the time t12 in FIG. 6) and the operating state (the request engine torque (refer to the broken line in FIG. 6H)) reaches the constraint (the torque constraint TR).

In the example illustrated in FIGS. 1 and 6, the control device for an internal combustion engine of the first embodiment is applied to the engine system having the turbocharger 32, but in another example, the control device for an internal combustion engine of the first embodiment can be also applied to an engine system that does not have the turbocharger 32, instead.

Figure 7:
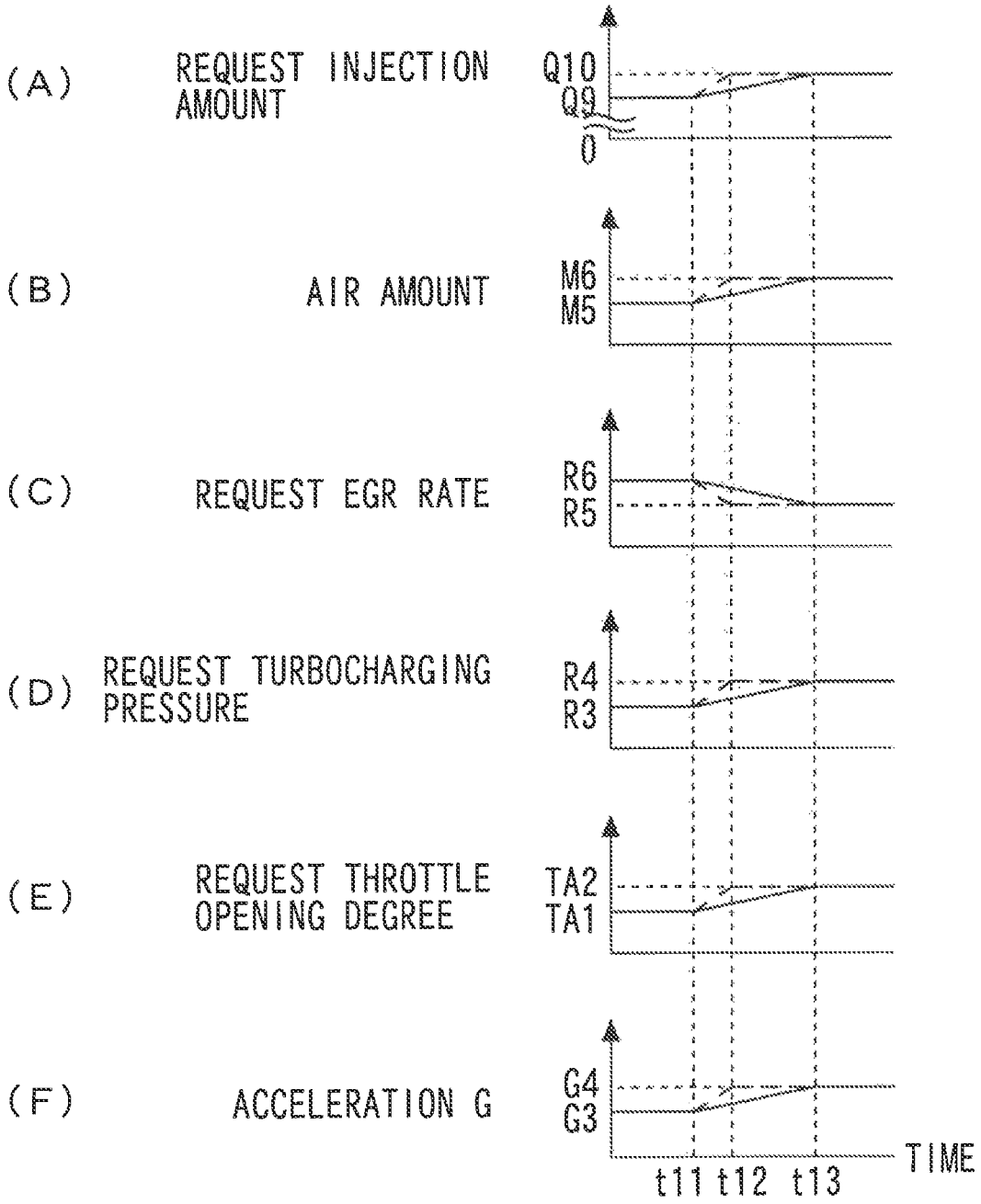
FIG. 7 is a time chart for explaining control at the time of accelerator opening degree increase in a case where a present operating state in another example of the engine system to which the control device for an internal combustion engine of the first embodiment is applied is close to a constraint.

FIG. 7 is a time chart for explaining control at the time of accelerator opening degree increase in a case where a present operating state is close to the constraint in another example of the engine system to which the control device for an internal combustion engine of the first embodiment is applied.

In the example illustrated in FIG. 7 of the engine system to which the control device for an internal combustion engine of the first embodiment is applied, at the time of accelerator opening degree increase in the case of the present operating state (the request engine torque) being close to the constraint (the torque constraint), in order to increase the acceleration G (refer to FIG. 7F) gradually from the value G3 to the value G4, the request injection amount (refer to FIG. 7A) is gradually increased from a value Q9 to a value Q10, a request EGR rate (refer to FIG. 7C) is gradually decreased from a value R6 to a value R5, a request turbocharging pressure (refer to FIG. 7D) is gradually increased from a value P3 to a value P4, and a request throttle opening degree (refer to FIG. 7E) is gradually increased from a value TA1 to a value TA2. Further, an air amount (refer to FIG. 7B) is gradually increased from a value M5 to a value M6.

More specifically, in the example illustrated in FIG. 7 of the engine system to which the control device for an internal combustion engine of the first embodiment is applied, in step S108 (refer to FIG. 2), the request state quantity calculating section 10*d* (refer to FIG. 1) calculates the request injection amount [$mm^3$/st] (refer to FIG. 1 and FIG. 7A), the request EGR rate [–] (refer to FIG. 1 and FIG. 7C), the request turbocharging pressure [kPa] (refer to FIG. 1 and FIG. 7D), and a request throttle opening degree [%] (refer to FIG. 1 and FIG. 7E).

In more detail, in the example illustrated in FIG. 7 of the engine system to which the control device for an internal combustion engine of the first embodiment is applied, at the time of accelerator opening degree increase (in the time period from the time t11 to the time t13) in the case where the present operating state (the request engine torque) is close to the constraint (the torque constraint), the target acceleration increase amount ΔG (refer to FIG. 1) calculated by using the relation RL3 (refer to FIG. 4) in which the ratio of the target acceleration increase amount ΔG and the accelerator opening degree increase amount ΔPa is small is used in calculation of the request injection amount, the request EGR rate, the request turbocharging pressure and the request throttle opening degree.

Further, in step S109 (refer to FIG. 2), based on the request injection amount calculated in step S108, the fuel injection valve 30 (refer to FIG. 1) is controlled by the control device 10 (refer to FIG. 1). Further, in step S109, the control device 10 controls an EGR valve (not illustrated) of the EGR device 31 (refer to FIG. 1), a wastegate valve (not illustrated) of the turbocharger 32 (refer to FIG. 1) and the throttle valve 33 (refer to FIG. 1), based on the request EGR rate, the request turbocharging pressure and the request throttle opening degree which are calculated in step S108.

If the target acceleration increase amount ΔG (refer to FIG. 1) calculated by using the relation RL1 (refer to FIG. 4) in which the ratio of the target acceleration increase amount ΔG and the accelerator opening degree increase amount ΔPa is large is used in calculation of the request injection amount (refer to FIG. 1 and FIG. 7A), the request EGR rate (refer to FIG. 1 and FIG. 7C), the request turbocharging pressure (refer to FIG. 1 and FIG. 7D) and the request throttle opening degree (refer to FIG. 1 and FIG. 7E), in the example illustrated in FIG. 7, in the time period from the time t11 to the time t12, the request injection amount increases from the value Q9 to the value Q10 as illustrated by a broken line in FIG. 7A, the air amount increases from the value M5 to the value M6 as illustrated by a broken line in FIG. 7B, the request EGR rate decreases from the value R6 to the value R5 as illustrated by a broken line in FIG. 7C, the request turbocharging pressure increases from the value P3 to the value P4 as illustrated by a broken line in FIG. 7D, the request throttle opening degree increases from the value TA1 to the value TA2 as shown by a broken line in FIG. 7E, and the acceleration G increases from the value G3 to the value G4 as shown by a broken line in FIG. 7F, in the time period from the time t11 to the time t12.

As described above, in the example illustrated by the solid lines in FIG. 6 of the engine system to which the control device for an internal combustion engine of the first embodiment is applied, at the time of accelerator opening degree increase (in the time period from the time t11 to the time t13) in the case where the present operating state (the request engine torque) is close to the constraint (the torque constraint), the target acceleration increase amount ΔG (refer to FIG. 1 and FIG. 6D) calculated by using the relation RL3 (refer to FIG. 4) in which the ratio of the target acceleration increase amount ΔG and the accelerator opening degree increase amount ΔPa is small is used in calculation of the request injection amount (refer to FIG. 6I).

Further, as described above, in the example illustrated in FIG. 7 of the engine system to which the control device for an internal combustion engine of the first embodiment is applied, at the time of accelerator opening degree increase (in the time period from the time t11 to the time t13) in the case where the present operating state (the request engine torque) is close to the constraint (the torque constraint), the target acceleration increase amount ΔG (refer to FIG. 1 and FIG. 6D) calculated by using the relation RL3 (refer to FIG. 4) in which the ratio of the target acceleration increase amount ΔG and the accelerator opening degree increase amount ΔPa is small is used in calculation of the request injection amount (refer to FIG. 7A), the request EGR rate (refer to FIG. 7C), the request turbocharging pressure (refer to FIG. 7D) and the request throttle opening degree (refer to FIG. 7E).

Meanwhile, in another example (not illustrated) of the engine system to which the control device for an internal combustion engine of the first embodiment is applied, at the time of accelerator opening degree increase in the case where the present operating state (the request engine torque) is close to the constraint (the torque constraint), the target acceleration increase amount ΔG (refer to FIG. 1 and FIG. 6D) calculated by using the relation RL3 (refer to FIG. 4) in which the ratio of the target acceleration increase amount ΔG and the accelerator opening degree increase amount ΔPa is small is used in calculation of the request injection amount, and can be also used in calculation of arbitrary one or two of the request EGR rate, the request turbocharging pressure and the request throttle opening degree, instead.

In the example illustrated in FIG. 1 of the engine system to which the control device for an internal combustion engine of the first embodiment is applied, the target torque increase amount [Nm] is calculated by the vehicle model 10*c* based on the target acceleration increase amount ΔG [$m/s^2$], and the torque increase amount correction amount [Nm] is calculated based on the target torque increase amount [Nm] next, whereas in another example (not illustrated) of the engine system to which the control device for an internal combustion engine of the first embodiment is applied, the torque increase amount correction amount [Nm] can be also calculated based on the target acceleration increase amount ΔG [m/s$^2$] via arbitrary means (not illustrated) other than the vehicle model 10*c*, instead.

Hereinafter, a second embodiment of the control device for an internal combustion engine of the present disclosure will be described.

An engine system to which the control device for an internal combustion engine of the second embodiment is applied is configured substantially similarly to the engine system to which the control device for an internal combustion engine of the first embodiment described above is applied, except for a point that will be described later. Consequently, according to the engine system to which the control device for an internal combustion engine of the second embodiment is applied, a substantially similar effect to the aforementioned engine system to which the control device for an internal combustion engine of the first embodiment described above is applied can be provided, except for a point that will be described later.

As described above, in the engine system to which the control device for an internal combustion engine of the first embodiment is applied, as the constraint under which the acceleration G does not increase even when the driver increases the accelerator opening degree Pa, the torque constraint TR (refer to FIG. 5B and FIG. 6B) under which even when the request torque is increased, the torque actually outputted does not increase is used, and is inputted to the target acceleration increase amount calculating section 10*b* (refer to FIG. 1).

In the engine system to which the control device for an internal combustion engine of the second embodiment is applied, instead of the above, a smoke emission amount constraint under which the request injection amount (the fuel injection amount) (refer to FIG. 1) does not increase even when the driver increases the accelerator opening degree Pa is used as the constraint in which the acceleration C does not increase even when the driver increases the accelerator opening degree Pa, and is inputted to the target acceleration increase amount calculating section 10*b*. By setting the smoke emission amount constraint, the smoke emission amount can be prevented from being a predetermined value or more.

In the engine system to which the control device for an internal combustion engine of the second embodiment is applied, in step S102 (refer to FIG. 2), one of the three relations RL1, RL2 and RL3 illustrated in FIG. 4 is selected based on the present operating state (the smoke emission amount) and the constraint (the smoke emission amount constraint).

More specifically, the engine system to which the control device for an internal combustion engine of the second embodiment is applied, the relation RL1 in which the ratio of the target acceleration increase amount ΔG and the accelerator opening degree increase amount ΔPa is large is selected in step S102, when the present operating state (the smoke emission amount) is not close to the constraint (the smoke emission amount constraint).

When the present operating state (the smoke emission amount) is close to the constraint (the smoke emission amount constraint), the relation RL3 in which the ratio of the target acceleration increase amount ΔG and the accelerator opening degree increase amount ΔPa is small is selected in step S102.

When the present operating state (the smoke emission amount) is relatively close to the constraint (the smoke emission amount constraint) although the present operating state is not so close to the constraint as in the case where the relation RL3 is selected, and the operating state (the smoke emission amount) is likely to reach the constraint (the smoke emission amount constraint) if the acceleration is quickly increased, the relation RL2 in which the ratio of the target acceleration increase amount ΔG and the accelerator opening degree increase amount ΔPa is smaller than in the relation RL1 is selected.

In the engine system to which the control device for an internal combustion engine of the second embodiment is applied, the request injection amount (refer to FIG. 6I) can be gradually increased from the value Q3 to the value Q4 in the acceleration request time period (in the time period from the time t11 to the time t13 in FIG. 6) by the driver by using the relation RL3 (refer to FIG. 4) in which the ratio of the target acceleration increase amount ΔG and the accelerator opening degree increase amount ΔPa is small, when the present operating state (the smoke emission amount) is close to the constraint (the smoke emission amount constraint), whereby the acceleration G (refer to FIG. 6J) can be gradually increased from the value G3 to the value G4.

That is, in the engine system to which the control device for an internal combustion engine of the second embodiment is applied, in the acceleration request time period (in the time period from the time t11 to the time t13 in FIG. 6) by the driver, the acceleration G can be continuously increased without causing the operating state (the smoke emission amount) to reach the constraint (the smoke emission amount constraint).

That is, in the engine system to which the control device for an internal combustion engine of the second embodiment is applied, increase of the acceleration G that satisfies the acceleration request by the driver can be realized even when the present operating state (the smoke emission amount at the time point of the time t11 in FIG. 6) is close to the constraint (the smoke emission amount constraint).

Hereinafter, a third embodiment of the control device for an internal combustion engine of the present disclosure will be described.

The engine system to which the control device for an internal combustion engine of the third embodiment is applied is configured to be substantially similar to the engine system to which the control device for an internal combustion engine of the first embodiment described above is applied, except for a point that will be described later. Consequently, according to the engine system to which the control device for an internal combustion engine of the third embodiment is applied, a substantially similar effect to the engine system to which the control device for an internal combustion engine of the first embodiment described above is applied can be provided, except for a point that will be described later.

In the engine system to which the control device for an internal combustion engine of the third embodiment is applied, an emission purifying catalyst temperature constraint under which the request injection amount (the fuel injection amount) (refer to FIG. 1) does not increase even when the driver increases the accelerator opening degree Pa is used as the constraint in which the acceleration G does not increase even when the driver increases the accelerator opening degree Pa, and is inputted to the target acceleration increase amount calculating section 10*b* (refer to FIG. 1). By setting the emission purifying catalyst temperature constraint, a possibility of emission being worsened as the temperature of an emission purifying catalyst (not illustrated) becomes a predetermined value or more can be restrained.

In the engine system to which the control device for an internal combustion engine of the third embodiment is applied, in step S102 (refer to FIG. 2), one of the three relations RL1, RL2 and RL3 illustrated in FIG. 4 is selected based on the present operating state (the emission purifying catalyst temperature) and the constraint (the emission purifying catalyst temperature constraint).

More specifically, in the engine system to which the control device for an internal combustion engine of the third embodiment is applied, the relation RL1 in which the ratio of the target acceleration increase amount ΔG and the accelerator opening degree increase amount ΔPa is large is selected in step S102, when the present operating state (the emission purifying catalyst temperature) is not close to the constraint (the emission purifying catalyst temperature constraint).

When the present operating state (the emission purifying catalyst temperature) is close to the constraint (the emission purifying catalyst temperature constraint), the relation RL3 in which the ratio of the target acceleration increase amount ΔG and the accelerator opening degree increase amount ΔPa is small is selected in step S102.

When the present operating state (the emission purifying catalyst temperature) is relatively close to the constraint (the emission purifying catalyst temperature constraint) although the present operating state is not so close to the constraint as in the case where the relation RL3 is selected, and the operating state (the emission purifying catalyst temperature) is likely to reach the constraint (the emission purifying catalyst temperature constraint) if the acceleration is quickly increased, the relation RL2 is selected, in which the ratio of the target acceleration increase amount ΔG and the accelerator opening degree increase amount ΔPa is smaller than in the relation RL1.

In the engine system to which the control device for an internal combustion engine of the third embodiment is applied, the request injection amount (refer to FIG. 6I) can be gradually increased from the value Q3 to the value Q4 in the acceleration request time period (in the time period from the time t11 to the time t13 in FIG. 6) by the driver by using the relation RL3 (refer to FIG. 4) in which the ratio of the target acceleration increase amount ΔG and the accelerator opening degree increase amount ΔPa is small, when the present operating state (the emission purifying catalyst temperature) is close to the constraint (the emission purifying catalyst temperature constraint), whereby the acceleration G (refer to FIG. 6J) can be gradually increased from the value G3 to the value G4.

That is, in the engine system to which the control device for an internal combustion engine of the third embodiment is applied, in the acceleration request time period (the time period from the time t11 to the time t13 in FIG. 6) by the driver, the acceleration G can be continuously increased without causing the operating state (the emission purifying catalyst temperature) to reach the constraint (the emission purifying catalyst temperature constraint).

That is, in the engine system to which the control device for an internal combustion engine of the third embodiment is applied, increase of the acceleration G that satisfies the acceleration request by the driver can be realized even when the present operating state (the emission purifying catalyst temperature at the time point of the time t11 in FIG. 6) is close to the constraint (the emission purifying catalyst temperature constraint).

Parameters that should be restrained to be less than predetermined values in a vehicle that is loaded with an engine system include NV (noise, and vibration).

In the engine system to which a control device for an internal combustion engine of a fourth embodiment is applied, as the constraint under which the acceleration G does not increase even when the driver increases the accelerator opening degree Pa, an NV constraint under which the request injection amount (the fuel injection amount) (refer to FIG. 1) does not increase even when the driver increases the accelerator opening degree Pa is used. By setting the NV constraint, NV can be restrained from being a predetermined value or more. NV is calculated by using a transmission output shaft rotational speed, for example.

Parameters that should be restrained to be less than predetermined values in the engine system having the turbocharger 32 (refer to FIG. 1) include a turbo rotational speed.

In an engine system to which a control device for an internal combustion engine of a fifth embodiment is applied, as the constraint under which the acceleration G does not increase even when the driver increases the accelerator opening degree Pa, a turbo rotational speed constraint under which the request injection amount (the fuel injection amount) (refer to FIG. 1) does not increase even when the driver increases the accelerator opening degree Pa is used. By setting the turbo rotational speed constraint, a turbo rotational speed can be restrained from being a predetermined value or more. The turbo rotational speed is acquired by using a turbo rotational speed sensor (not illustrated), for example.

Parameters that should be restrained to be less than predetermined values in the engine system having the turbocharger 32 (refer to FIG. 1) include a turbocharging pressure.

In an engine system to which a control device for an internal combustion engine of a sixth embodiment is applied, as the constraint under which the acceleration G does not increase even when the driver increases the accelerator opening degree Pa, a turbocharging pressure constraint under which the request injection amount (the fuel injection amount) (refer to FIG. 1) does not increase even when the driver increases the accelerator opening degree Pa is used. By setting the turbocharging pressure constraint, the turbocharging pressure can be restrained from being a predetermined value or more. The turbocharging pressure is acquired by using a turbocharging pressure sensor (not illustrated), for example.

In an engine system to which a control device for an internal combustion engine of a seventh embodiment is applied, the constrains that are set in the engine systems to which the control devices for an internal combustion engine of the first to the sixth embodiments described above are applied also can be properly combined.

In an eighth embodiment, the first to the seventh embodiments and the respective examples described above also can be properly combined.

The invention claimed is:

1. A control device for an internal combustion engine comprising a fuel injection valve, and an accelerator opening degree sensor, the control device comprising:

a basic accelerator request torque calculating section calculating a basic accelerator request torque based on an accelerator opening degree detected by the accelerator opening degree sensor; and a target acceleration increase amount calculating section calculating a target acceleration increase amount based on a relation of the target acceleration increase amount and an accelerator opening degree increase amount, wherein the control device calculates a torque increase amount correction amount based on the target acceleration increase amount, calculates a request engine torque based on the basic accelerator request torque and the torque increase amount correction amount, calculates a request injection amount based on the request engine torque, and controls the fuel injection valve based on the request injection amount, and the relation of the target acceleration increase amount and the accelerator opening degree increase amount, which is used in calculation of the target acceleration increase amount, is such that as a present operating state is closer to a constraint, a ratio of the target acceleration increase amount and the accelerator opening degree increase amount becomes smaller.

2. The control device for an internal combustion engine according to claim 1, wherein the relation of the target acceleration increase amount and the accelerator opening degree increase amount is set, based on a relation in which a ratio of the accelerator opening degree increase amount and the accelerator opening degree is proportional to a ratio of the target acceleration increase amount and a target acceleration.

3. The control device for an internal combustion engine according to claim 1, wherein an increase amount per accelerator opening degree increase amount, of the request injection amount calculated by the control device at a time of accelerator opening degree increase becomes smaller as the present operating state is closer to the constraint.

* * * * *